US011333146B2

(12) United States Patent
Nelle

(10) Patent No.: US 11,333,146 B2
(45) Date of Patent: May 17, 2022

(54) GAS LIFT COMPRESSOR SYSTEM AND METHOD FOR SUPPLYING COMPRESSED GAS TO MULTIPLE WELLS

(71) Applicant: Estis Compression, LLC, Kilgore, TX (US)

(72) Inventor: Will Nelle, San Angelo, TX (US)

(73) Assignee: ESTIS COMPRESSION, LLC, Kilgore, TX (US)

( * ) Notice: Subject to any disclaimer, the term of this patent is extended or adjusted under 35 U.S.C. 154(b) by 0 days.

(21) Appl. No.: 17/541,853

(22) Filed: Dec. 3, 2021

(65) Prior Publication Data

US 2022/0090595 A1 Mar. 24, 2022

Related U.S. Application Data

(63) Continuation of application No. 16/588,472, filed on Sep. 30, 2019, now Pat. No. 11,193,483.

(51) Int. Cl.

| | |
|---|---|
| ***F04B 49/22*** | (2006.01) |
| ***F04B 39/06*** | (2006.01) |
| ***F04B 27/24*** | (2006.01) |
| ***F04B 39/16*** | (2006.01) |
| ***E21B 43/12*** | (2006.01) |
| ***F04B 35/00*** | (2006.01) |

(52) U.S. Cl.

CPC ..... *F04B 49/225* (2013.01); *E21B 43/122* (2013.01); *F04B 27/24* (2013.01); *F04B 39/06* (2013.01); *F04B 39/16* (2013.01); *F04B 35/002* (2013.01); *F04B 2205/09* (2013.01)

(58) Field of Classification Search

CPC ..... F04B 49/03; F04B 49/22; F04B 49/243; F04B 49/225; F04B 49/065; F04B 7/0076; F04B 39/06; F04B 39/08; F04B 39/16; F04B 25/02; F04B 41/06; F04B 51/00; F04B 27/24; F04B 2201/0207; E21B 43/122

See application file for complete search history.

(56) References Cited

U.S. PATENT DOCUMENTS 1,898,729 A * 2/1933 Huguenin ..... F04B 39/08 417/267
3,844,686 A * 10/1974 Le Blanc ..... F04B 49/243 417/298
4,315,716 A * 2/1982 de Backer ..... F04B 49/08 417/27

(Continued)

*Primary Examiner* — Nathan C Zollinger
(74) *Attorney, Agent, or Firm* — Jason P. Mueller; FisherBroyles, LLP

(57) ABSTRACT

A high pressure gas lift compressor system and method of using the system for supplying compressed gas to multiple wells are provided. The system includes a compressor having multiple compressor cylinders. Each cylinder has its own gas inlet line and dedicated gas outlet line that supplies compressed gas from that cylinder directly to a wellbore to provide artificial gas lift. Each cylinder also has its own control valve upstream of the cylinder to control the suction pressure to the cylinder. A desired gas flow rate to each well may be input, and the control valve is adjusted accordingly to achieve the flow rate. By inputting a flow rate for each separate cylinder, the flow rate to each well may be independently controlled.

18 Claims, 5 Drawing Sheets

(56) References Cited

U.S. PATENT DOCUMENTS

| | | | | |
|---|---|---|---|---|
| 4,362,475 | A * | 12/1982 | Seitz | F04B 39/08 417/295 |
| 7,403,850 | B1 * | 7/2008 | Boutin | G01M 15/05 701/107 |
| 8,206,125 | B2 * | 6/2012 | Kuttler | F04B 11/005 417/505 |
| 2011/0127051 | A1 * | 6/2011 | Guse | A62C 5/02 222/61 |

* cited by examiner

GAS LIFT COMPRESSOR SYSTEM AND METHOD FOR SUPPLYING COMPRESSED GAS TO MULTIPLE WELLS

This patent application is a continuation of U.S. patent application Ser. No. 16/588,472, filed on Sep. 30, 2019, the disclosures of which are incorporated herein by reference in their entireties.

FIELD OF THE DISCLOSURE

The subject matter of the present disclosure refers generally to gas lift systems and methods for hydrocarbon recovery operations from multiple wells.

BACKGROUND

Wellbores drilled for the production of oil and gas often produce fluids in both the gas and liquid phases. Produced liquid phase fluids may include hydrocarbon oils, natural gas condensate, and water. When a well is first completed, the initial formation pressure is typically sufficient to force liquids up the wellbore and to the surface along with the produced gas. However, during the life of a well, the natural formation pressure tends to decrease as fluids are removed from the formation. As this downhole pressure decreases over time, the velocity of gases moving upward through the wellbore also decreases, thereby resulting in a steep production decline of liquid phase fluids from the well. Additionally, the hydrostatic head of fluids in the wellbore may significantly impede the flow of gas phase fluids into the wellbore from the formation, further reducing production. The result is that a well may lose its ability to naturally produce fluids in commercially viable quantities over the course of the life of the well.

In order to increase production from such a well, various artificial lift methods have been developed. A common and well-established artificial lift method is gas lift. In gas lift methods, a gas is injected into the wellbore downhole to lighten, or reduce the density of, the fluid column by introducing gas bubbles into the column. A lighter fluid column results in a lower bottom hole pressure, which increases fluid production rates from the well. Gas lift is a method that is very tolerant of particulate-laden fluids and is also effective on higher gas oil ratio (GOR) wells. As such, gas lift has become a commonly utilized artificial lift method in shale oil and gas wells.

In conventional gas lift methods, a gas lift compressor at the surface injects gas through multiple gas lift valves positioned vertically along the production tubing string. Conventional gas lift compressors typically have a discharge pressure in the range of 1,000 to 1,200 psig. However, there are disadvantages in conventional gas lift compressor systems. For instance, the fluid lift rates achievable by conventional gas lift compressors are typically limited, which limits the effectiveness of gas lift operations. Although conventional gas lift compressors may achieve higher lift rates than some other artificial lift methods, such as beam pumping, or the sucker-rod lift method, gas lift typically does not produce the same lift rates of other methods such as electric submersible pumps (ESPs).

To overcome limited fluid lift rates, the use of high pressure gas lift (HPGL) compressors has gained traction in the oil and gas industry in recent years, and the use of HPGL booster compressors has increased rapidly since 2017. The HPGL process is a variation on conventional gas lift methods in which no gas lift valves are required in the production tubing string. Instead, compressed gas is injected into the wellbore fluid column near the end of tubing (EOT), thereby reducing the density of the entire fluid column, which provides higher production rates as compared to conventional gas lift methods. Like conventional gas lift compressors, HPGL compressors are tolerant of particulate-laden fluids and high GORs and typically provide fluid lift rates comparable to ESPs. However, the HPGL gas lift process requires a source of compressed gas at a significantly higher pressure than the compressed gas utilized in conventional gas lift processes.

HPGL gas lift compressors are typically designed to produce compressed gas at a discharge pressure of up to 4,000 psig in order to provide an adequate injection gas flow rate. However, if multiple wells are to be serviced with a high pressure gas lift compressor, injecting gas at such high pressures may cause operational problems. In conventional gas lift compressor operations, compressed gas is often supplied to multiple wells from a single compressor skid simply by splitting the discharge flow of gas from the lift compressor into multiple streams to supply gas to each individual well. Thus, all of the streams have the same discharge pressure. However, different wells often have different injection gas flow requirements, which requires compressed gas at different pressures depending on the well. In this case, the compressor discharge pressure may be set at the highest required pressure, and gas streams required to be at a lower pressure are simply pressured down to the required pressure. There are at least two problems with this common practice. First, some of the gas streams supplied to multiple wells may be pressurized up to unnecessarily high pressures, which is inefficient and increases operating costs. Second, gas streams that are pressured down may experience rapid cooling due to the Joule-Thomson effect, which may cause the formation of natural gas hydrates. Hydrates may block gas injection lines, thereby halting the gas flow and thus halting the gas lift operation. To counter the formation of hydrates, some well operators inject methanol to function as an antifreeze, which further increases operating costs.

The problem of hydrates formation occurs even with conventional gas lift compressors having discharge pressures in the range of 1,000 to 1,200 psig. However, this problem is significantly exacerbated in HPGL gas lift operations due to the higher discharge pressure of up to 4,000 psig. When utilizing gas at a higher pressure to service multiple wells, there is a greater potential for larger differences in the pressure requirements for individual wells, which may further exacerbate the problem of hydrates formation when pressuring down a gas stream from a very high pressure to a significantly lower pressure. Thus, simply splitting and pressuring down the gas flow from an HPGL gas lift compressor is impractical because operators need to have the ability to individually adjust the gas flow rates to multiple wells to accommodate changing well conditions at each well.

In addition, the typical mechanism for adjusting output gas flow rates from multiple compressor cylinders of a reciprocating compressor, as is typically used in gas lift operations, is to adjust the compressor speed and thus the speed at which the compressor cylinders operate. However, utilizing compressor speed to adjust gas flow rate results in all cylinders operating at the same speed, which limits the degree to which separate process streams may function independently. Thus, adjusting compressor speed is also not practical for individually controlling gas flow rates to multiple wells. To overcome these problems, a single HPGL compressor may be used to service each individual well separately. However, utilizing a separate compressor for every well requiring artificial gas lift in a field is inefficient and significantly increases associated operating costs of oil and gas production.

Accordingly, a need exists in the art for an improved gas compressor system that may be utilized for gas lift operations servicing multiple wells using a single compressor. Additionally, a need exists in the art for an improved method of supplying compressed gas to multiple wells in a gas lift operation using a single compressor.

SUMMARY

A gas compressor system and a method of using the system to supply compressed gas to multiple wellbores for gas lift operations are provided. The system may be utilized in gas lift operations to service multiple wells using a single compressor skid by supplying separate compressed gas streams each flowing to separate wellbores from separate compressor cylinders of a single compressor. The flow rate in each of the compressed gas streams may be independently controlled to accommodate different conditions at each individual well. Thus, gas streams from a single compressor skid may be injected into different wellbores at different pressures without the necessity of pressuring down some high pressure gas streams to a lower pressure as needed for certain wellbores. The present compressor system and method is particularly advantageous in high pressure gas lift (HPGL) operations supplying gas to multiple wells at pressures up to 4,000 psig.

The compressor system comprises a compressor comprising a plurality of compressor cylinders and a compressor engine operably coupled to each of the compressor cylinders. The compressor engine is configured to simultaneously drive each of the compressor cylinders. Thus, the system may utilize a single engine to operate all of the compressor cylinders. The compressor is preferably a two throw, a four throw, or a six throw reciprocating compressor. Each compressor cylinder has a gas inlet line and its own dedicated gas outlet line, each of which independently supplies compressed gas to a single well. Thus, in a preferred embodiment, a single compressor skid may provide wellbore injection gas to two, four, or six individual wells, and the flow rate to each of these wells may be controlled independently to optimize the gas flow rate to each of the wells.

To independently control the gas flow rate to each well, the compressor system further comprises a plurality of control valves each corresponding to a respective compressor cylinder. Each control valve is positioned on a gas inlet line upstream of a compressor cylinder. Each control valve is configured to independently control the suction pressure to each compressor cylinder and thereby to independently control a gas flow rate through the gas outlet line of each compressor cylinder. In a preferred embodiment, the system comprises a plurality of flow meters and a plurality of controllers each corresponding to one of the control valves. The flow meters are preferably positioned on gas inlet lines upstream of the control valves and are configured to measure the gas flow rate through each of the gas outlet lines to each well. Each controller is configured to receive gas flow rate value signals from a respective flow meter and, in response, to send control signals that actuate one of the control valves to control the suction pressure to the compressor cylinder that the corresponding control valve is positioned upstream of. Thus, the gas flow rate from each of the compressor cylinders may be independently controlled by independently controlling the suction pressure to each of the cylinders rather than by varying the speed of the compressor engine. This arrangement produces independent gas streams, which may have different discharge pressures, depending on a desired gas flow rate setpoint, without the need of pressuring down some gas streams to a lower pressure to accommodate some wellbores that may require a lower pressure than the maximum discharge pressure.

This arrangement also allows a single compressor skid to be used to provide gas lift operations to multiple wellbores, which provides efficiency gains and reductions in operating costs for the gas lift process. A single compressor skid may be utilized to service multiple wells by sharing some major components of the skid among the wells while providing some separate components that are dedicated to each individual well being supplied with compressed gas from each respective compressor cylinder. The common components may include the compressor engine, the compressor frame, and a control panel for operating the compressor skid. In addition, a common cooler structure may be utilized to cool compressed gas streams from all of the separate cylinders, as well as to provide cooling water to the compressor engine. All components may also share a common skid unit frame to which the components may be mounted on or secured to in order to provide a portable compressor skid that can be transported to any field location. However, certain components are dedicated to only providing compressed gas to an individual wellbore in order to allow independent control of gas flow rates from each compressor cylinder. These components include the compressor cylinders, gas outlet lines from each cylinder to each respective wellbore, and process control equipment for controlling the gas flow rate, which may include separate control valves, flow meters, and controllers for each gas outlet line. By utilizing some independent components along with some common shared components on a single compressor skid to service multiple wells, the gas flow rate to each well can be independently controlled without requiring the installation of entirely separate compressors for each well to be supplied with gas, which significantly improves both gas lift efficiency and operating costs for providing HPGL operations on multiple wells.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTON OF THE DRAWINGS

These and other features, aspects, and advantages of the present disclosure will become better understood with regard to the following description, appended claims, and accompanying drawings where:

DETAILED DESCRIPTION

Figure 1:
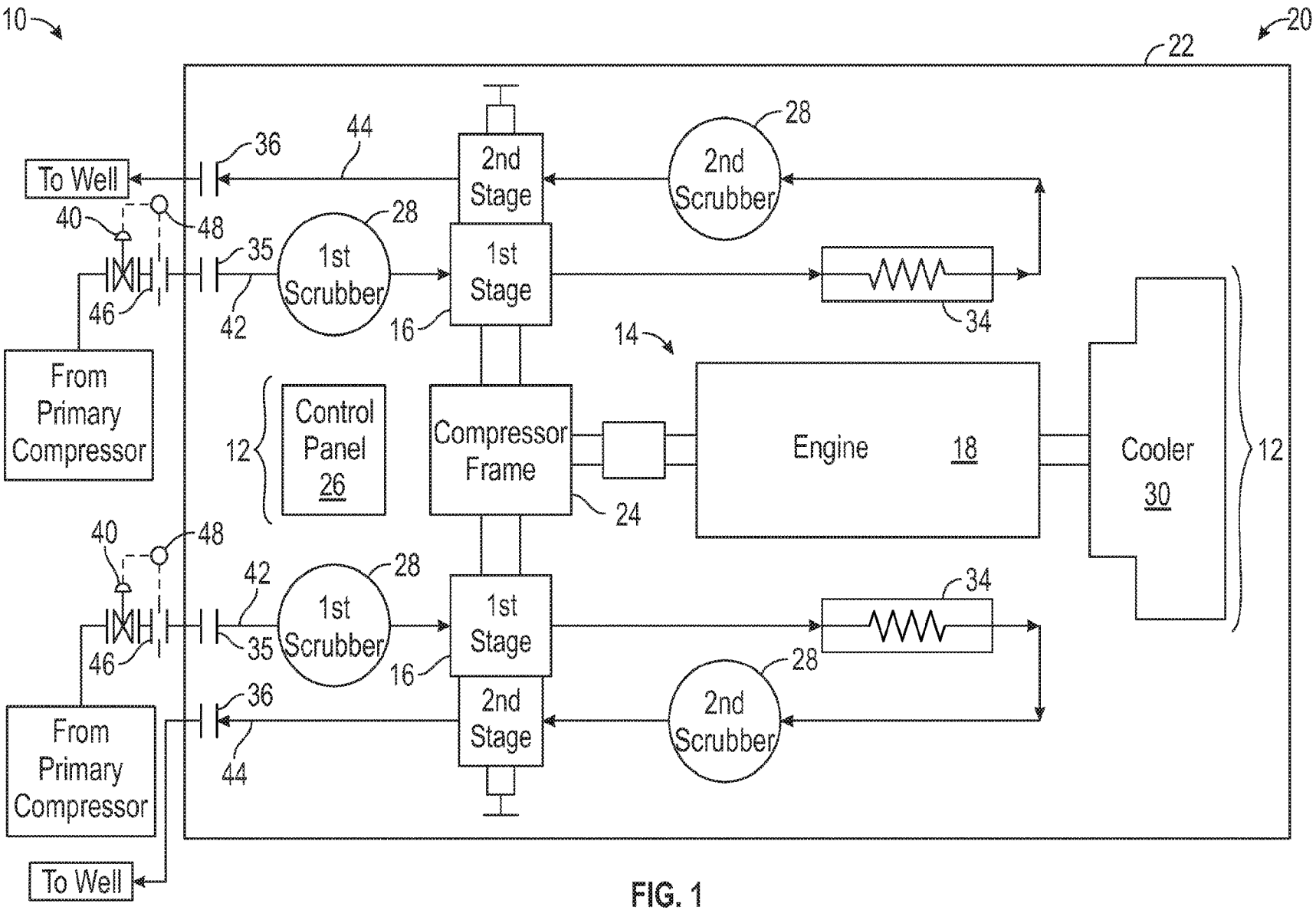
FIG. 1 shows a schematic diagram of a compressor skid unit in accordance with the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

A gas compressor system 10 and a method of using the system 10 to supply compressed gas to multiple wellbores 54 for gas lift operations are provided. FIGS. 1-5 illustrate preferred embodiments of the system 10. As shown in FIG. 4, the system 10 may be utilized in high pressure gas lift (HPGL) operations to service multiple wells 50 using a single compressor skid 20 by supplying separate compressed gas streams 44 each flowing to separate wellbores 52 from separate compressor cylinders 16 of a single compressor 14. The flow rate in each of the compressed gas streams 44 may be independently controlled to accommodate different conditions at each individual well 50. Thus, gas streams 44 from a single compressor skid 20 may be injected into different wellbores 52 at different pressures without the necessity of pressuring down high pressure gas streams 44 to a lower pressure.

Figure 4:
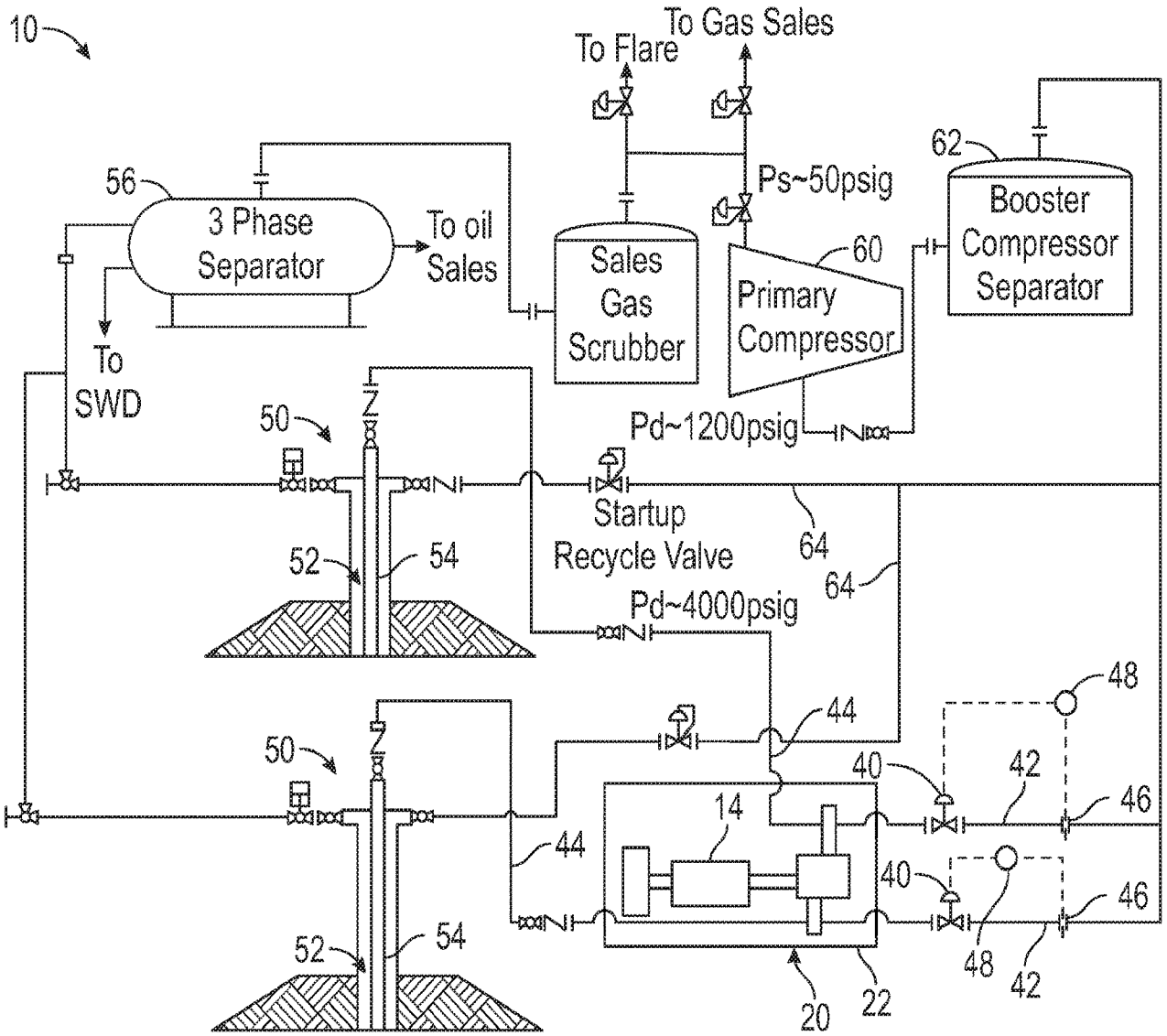
FIG. 4 shows a schematic diagram of a gas compressor system for supplying compressed gas to a plurality of wellbores in accordance with the present disclosure.
Figure 5:
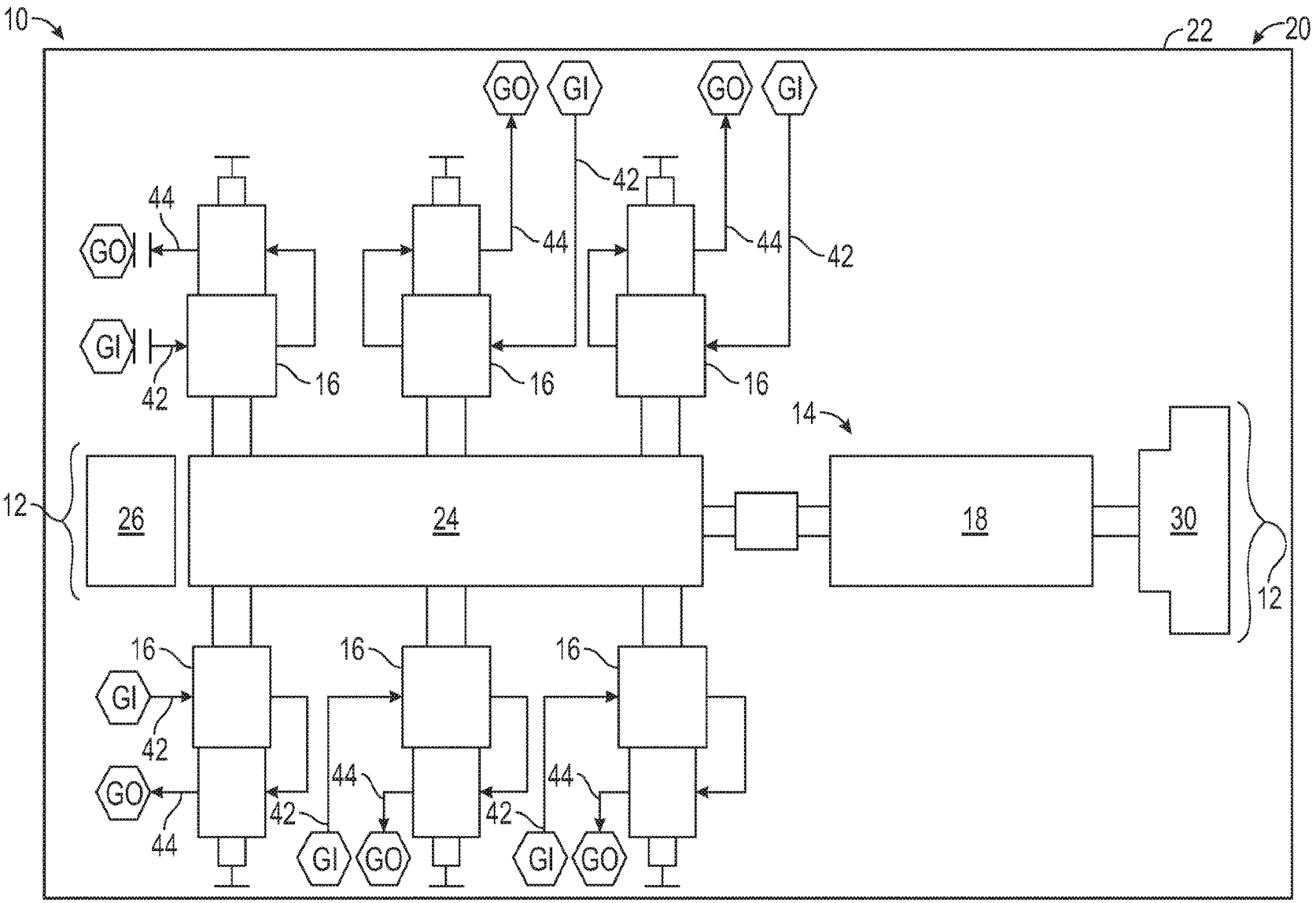
FIG. 5 shows a schematic diagram of a compressor skid unit in accordance with the present disclosure.

As shown in FIG. 1, the compressor system 10 comprises a compressor 14 comprising a plurality of compressor cylinders 16 and a compressor engine 18 that is operably coupled to each of the compressor cylinders 16 and configured to simultaneously drive each of the compressor cylinders 16. Thus, the system may utilize a single engine 18 to operate all of the compressor cylinders 16. As used herein, a "compressor cylinder" refers to a cylinder having a piston disposed therein to compress and displace gas within the cylinder, wherein the piston is driven by a rotating crankshaft coupled to the compressor engine 18. Thus, the compressor engine 18 is operably coupled to each of the compressor cylinders 16 and configured to simultaneously drive each of the compressor cylinders 16 by driving the crankshaft, which drives each piston contained within each cylinder in the plurality of compressor cylinders 16. Each compressor cylinder 16 has a gas inlet line 42 and its own dedicated gas outlet line 44 that independently supplies compressed gas to a single well 50. The compressor 14 is preferably a two throw, a four throw, or a six throw reciprocating compressor with each cylinder 16 of the compressor 14 being dedicated to a single well 50. To show a simple illustrative embodiment of the present compressor system 10, FIGS. 1-4 illustrate a two throw reciprocating compressor 14. FIG. 5 illustrates an alternative embodiment of the compressor system 10 utilizing a six throw reciprocating compressor 14 (with the separate coolers and scrubbers corresponding to each cylinder not shown for ease of illustration). Thus, in a preferred embodiment, a single compressor skid 20 may provide wellbore injection gas to two, four, or six individual wells 50, and the flow rate to each of these wells 50 may be controlled independently to optimize the gas flow rate to each well. Although a two throw, four throw, or six throw compressor is preferred due to such compressors being in common use in industry, in alternative embodiments the compressor 14 of the present system 10 may have an odd number of cylinders 16 within the plurality of compressor cylinders or may have more than six compressor cylinders 16.

To independently control the gas flow rate to each well 50, the compressor system 10 further comprises a plurality of control valves 40 each corresponding to a respective compressor cylinder 16. Each control valve 40 is positioned on a gas inlet line 42 upstream of a compressor cylinder 16, as best seen in FIGS. 1 and 4. Each control valve 40 is configured to independently control the suction pressure to each respective compressor cylinder 16 and thereby to independently control a gas flow rate through the gas outlet line 44 of each compressor cylinder 16. As used herein, a component of the system 10 "corresponds" to another component when those components are installed on the same gas stream through which the mass flow rate remains constant, which may include installation on the gas inlet line 42 upstream of a compressor cylinder 16 or the gas outlet line 44 downstream of the same cylinder 16. Thus, a control valve 40 corresponds to a compressor cylinder 16, for instance, when it is installed upstream of that cylinder on the gas line that provides gas directly to that cylinder to be compressed. Likewise, a flow meter 46 corresponds to a control valve 40, for instance, when it is installed upstream of the control valve on the same gas line.

To control the gas flow rate through each of the gas outlet lines 44, the system 10 preferably comprises a plurality of flow meters 46 and a plurality of controllers 48 each corresponding to one of the control valves 40. The flow meters 46 are preferably positioned on gas inlet lines 42 upstream of the control valves 40 and are configured to measure the gas flow rate through each of the gas outlet lines 44, as shown in FIG. 4. The flow meters 46 are preferably mass flow meters. Because each compressor cylinder 16 provides compressed gas to a single well 50, the mass flow rate of gas is the same in both the gas inlet line 42 into a cylinder 16 and the gas outlet line 44 discharging compressed gas from the cylinder 16. Thus, the flow meters 46 may be installed on either the gas inlet lines 42 or the gas outlet lines 44 to measure the gas flow rate through the outlet lines 44 and into the tubing string 54 of each wellbore 52. However, the flow meters 46 are preferably installed on the gas inlet lines 42 in which the pressure is lower so that flow meters do not have to be installed on the discharge gas lines 44, which have a higher pressure. Installing flow meters on high pressure discharge lines may often be impractical because the types of flow meters most commonly used in the oil field industry, such as orifice fittings, are often not rated for pressures up to 4,000 psig.

Each controller 48 is configured to receive gas flow rate value signals from a respective flow meter 46 and, in response, to send control signals that actuate the control valve 40 corresponding to the respective flow meter 46 to control the suction pressure to the respective compressor cylinder 16 that the corresponding control valve 40 is positioned upstream of Thus, the gas discharge flow rate from each of the compressor cylinders 16 may be independently controlled by independently controlling the suction pressure to each of the cylinders 16. In other commonly known compressor systems, the discharge flow rate is typically controlled by varying the speed of the compressor engine 18, but the present system 10 allows independent control of multiple discharge flow rates at a constant compressor engine speed. Thus, the compressor 14 speed may be set at the speed required to produce the highest desired discharge pressure based on well 50 conditions, which may be up to 4,000 psig, and the flow rate to other wells 50 requiring a lower discharge pressure may be controlled independently by adjusting the control valve 40 corresponding to the compressor cylinder 16 providing compressed gas to that particular well 50. Thus, the present system 10 produces independent gas streams 44, which may have different discharge pressures, depending on a desired gas flow rate setpoint for each gas stream, without varying the compressor speed and additionally without the need of pressuring down some discharge gas streams 44 downstream from the compressor to a lower pressure to accommodate some wellbores 52 that may require a lower pressure than the maximum discharge pressure.

Figure 2:
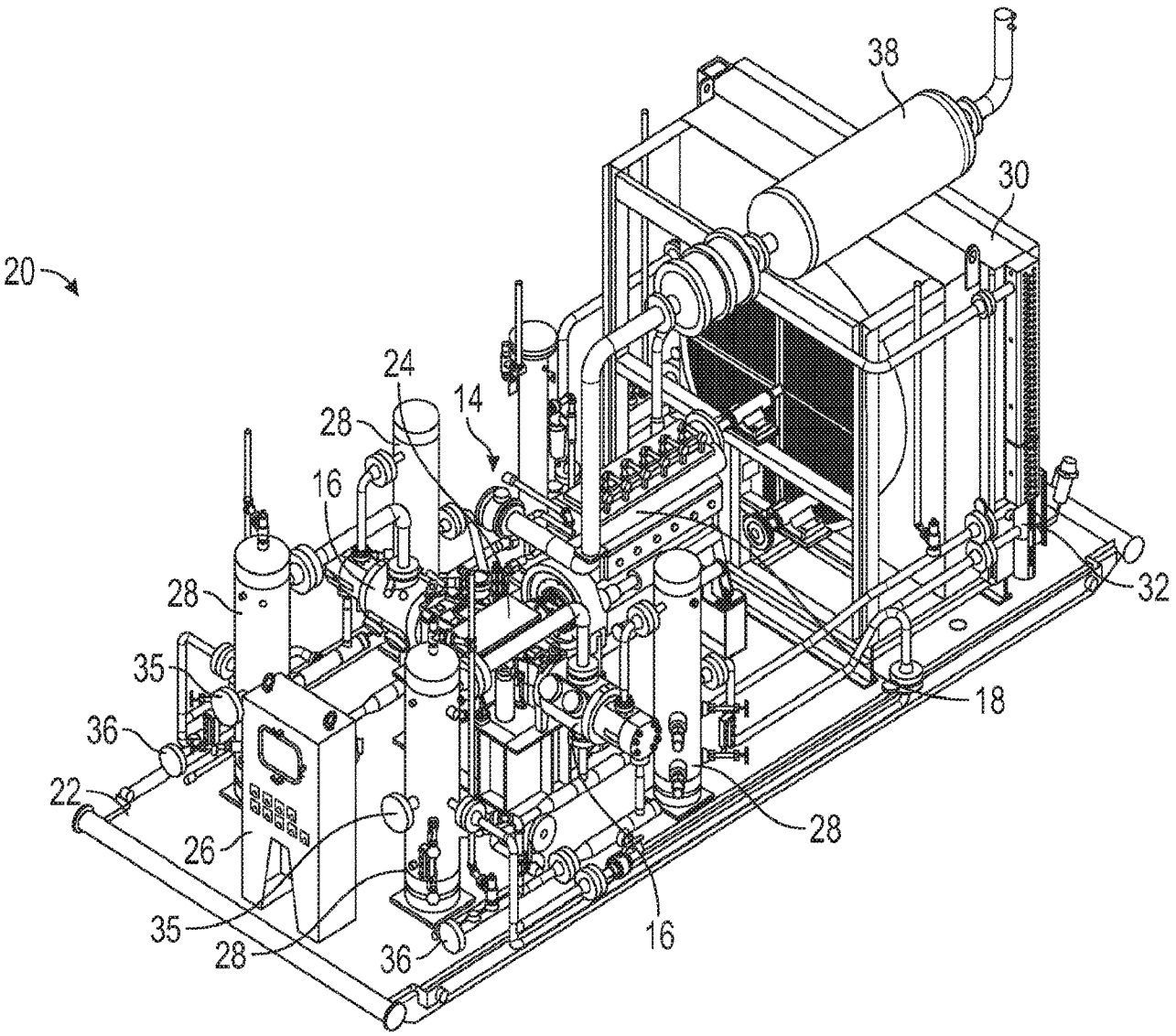
FIG. 2 shows a perspective view of a compressor skid unit in accordance with the present disclosure.
Figure 3:
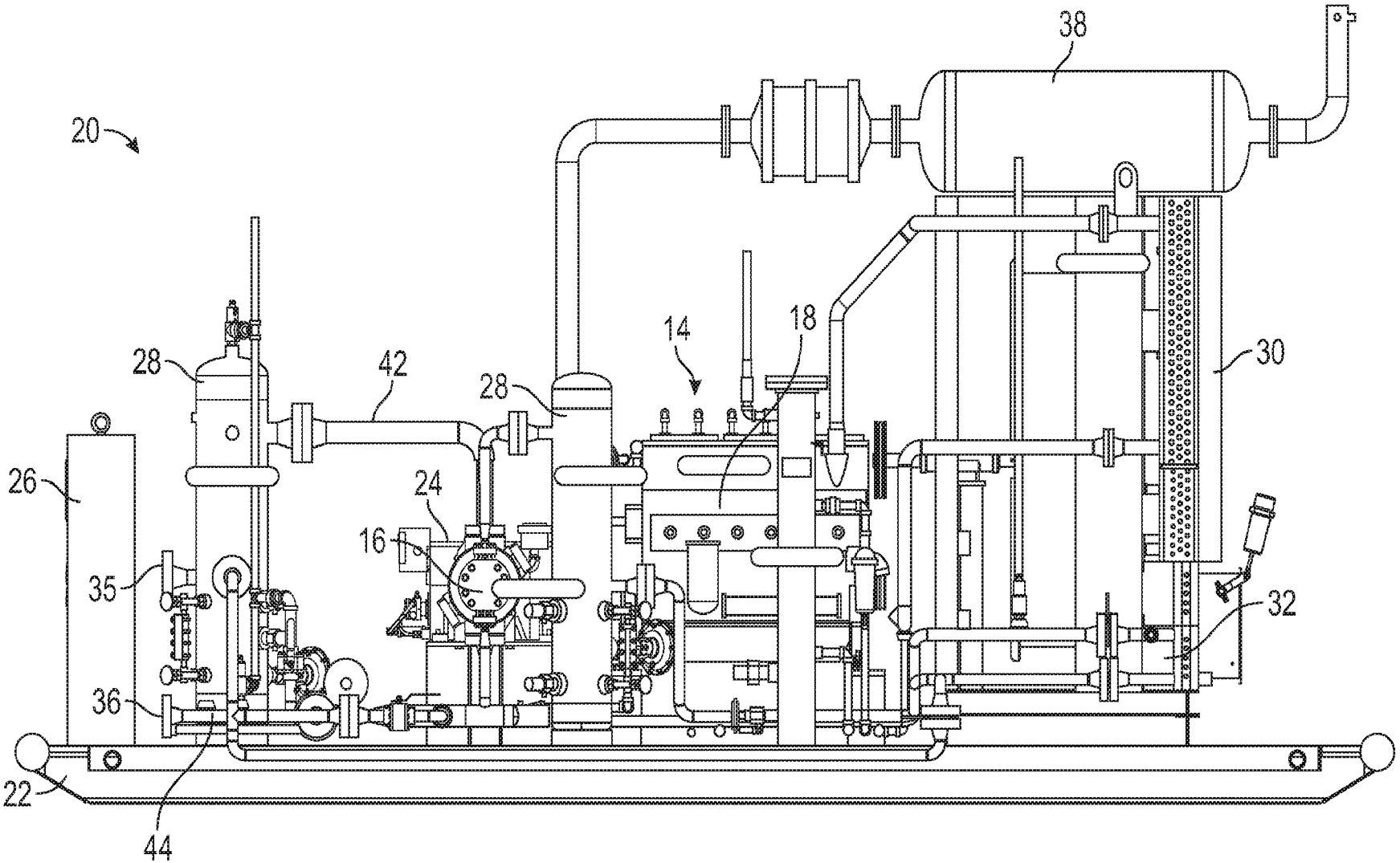
FIG. 3 shows a side elevational view of a compressor skid unit in accordance with the present disclosure.

As best seen in FIGS. 1-3, the present compressor system 10 allows a single compressor skid 20 to be used to provide gas lift operations to multiple wells 50, which provides efficiency gains and reductions in operating costs for the gas lift process. FIG. 1 shows a schematic diagram of a compressor skid 20 that may be utilized in the present compressor system 10. FIGS. 2 and 3 illustrate an illustrative compressor skid 20 in greater detail. In each of these figures, the compressor system 10 includes an illustrative two throw reciprocating compressor 14, which may be used to provide gas lift to two wells 50. A single compressor skid 20 may be utilized to service multiple wells 50 by sharing some major components 12 of the skid 20 while providing some separate components that are dedicated to each individual well 50 being supplied with compressed gas from each respective compressor cylinder 16. As best shown in FIG. 1, the common components 12 include the compressor engine 18, the compressor frame 24, and a control panel 26 for operating the compressor skid 20. In a preferred embodiment, each compressor cylinder 16 includes a first compression stage and a second compression stage. The gas in the inlet gas line 42 is compressed in the first stage and then passes through a cooler 34 before being further compressed to its final discharge pressure in the second stage. The compressor skid 20 shown in FIG. 1 illustrates separate coolers 34 for each gas stream and a cooler 30 for the compressor engine 18. In a preferred alternative embodiment, as shown in FIGS. 2 and 3, a common cooler structure 30 may be utilized to cool compressed gas streams from all of the separate cylinders 16, as well as to provide cooling water to the compressor engine 18. The cooling structure 30 may include separate cooling sections 32 designated for the compressed gas process streams. The skid 20 may also include a compressor exhaust 38 for the engine 18.

In a preferred embodiment, the compressor skid 20 comprises a plurality of scrubbers 28 each corresponding to a respective compressor cylinder 16. The scrubbers 28 are configured to remove liquid droplets, which may include a variety of liquid hydrocarbons that may condense out of the gas stream. In a preferred embodiment, as shown in FIG. 1, each compressor cylinder 16 has two scrubbers 28, one upstream of the first stage compressor and one upstream of the second stage compressor and downstream of the cooler 34.

As shown in FIGS. 2 and 3, components of the compressor system 10 may also share a common skid unit frame 22 to which the components may be mounted to provide a portable skid-mounted compressor unit 20 that can be transported to any field location. As used herein, a "skid" refers to a compressor system having components mounted onto a frame 22 so that the system may be transported as a single unit 20. In addition, the skid is sized to that the unit may be transported by cargo truck or rail as a single unit to any location as needed. The compressor 14, including the compressor engine 18, compressor frame 24, and compressor cylinders 16, is mounted directly onto the skid unit frame 22. In addition, the control panel 26, scrubbers 28, and coolers 34, which may be incorporated into a single cooling structure 30, along with associated piping, may also be mounted directly onto the skid unit frame 22.

Although some of the components of the skid 20 are common components 12 to both the skid 20 and to any of the multiple wells 50 serviced by the skid 20, certain components are dedicated to only providing compressed gas to an individual wellbore 52 in order to allow independent control of gas flow rates to the wellbore 52 from each compressor cylinder 16. These components include the compressor cylinders 16, gas outlet lines 44 from each cylinder 16 to each respective wellbore 52, and process control equipment for controlling the gas flow rate, which may include separate control valves 40, flow meters 46, and controllers 48, which are preferably installed on each gas inlet line 42. By utilizing some independent components along with some common components 12 on a single compressor skid 20 to service multiple wells 50, the gas flow rate to each well 50 can be independently controlled without requiring the installation of entirely separate compressors for each individual well to be supplied with compressed gas, which significantly improves both gas lift efficiency and operating costs for providing HPGL operations on multiple wells.

As best seen in FIG. 2, the portable compressor skid 20 may have a gas inlet line flange 35 and a gas outlet line flange 36 for connecting the gas inlet lines 42 and the gas outlet lines 44, respectively, to the compressor skid 20 after the skid has been transported to its location for intended use. In this embodiment, the process control equipment is thus "off-skid" and is installed after the skid 20 is put into place. In an optional embodiment, the skid 20 may include the control valves 40, flow meters 46, and controllers 48 "on-skid" for easier installation. In this embodiment, the control valves 40, flow meters 46, and controllers 48, and associated piping may additionally be mounted onto to the skid unit 20 so that later installation of these components is not required.

FIG. 4 illustrates the compressor system 10 utilizing the compressor skid 20 shown in FIGS. 1-3 being used to provide gas lift operations for two wells 50. FIG. 4 shows a two throw reciprocating compressor 14 servicing two wells 50, though additional compressor cylinders 16 may be included in the skid 20 design to service additional wells 50 corresponding to each cylinder 16. The system 10 comprises the compressor skid 20, including the compressor 14 and compressor cylinders 16, and process control equipment, including control valves 40, flow meters 46, and controllers 48. As shown in FIG. 4, the compressor system 10 is associated with two wellbores 52 by connecting the wells 50 to the discharge gas outlet lines 44 from each respective compressor cylinder 16 on the skid 20. Each wellbore 52 has a tubing string 54 positioned within the wellbore 52. Each gas outlet line 44 is configured to inject compressed gas from one respective compressor cylinder 16 into an interior of one respective tubing string 54 at a subsurface location, which is preferably at a single location near the end of tubing.

In a preferred embodiment, the working fluid for the compressor 14 is produced natural gas sourced from the wellbores 52. As shown in FIG. 4, the compressor system 10 may further comprise a three-phase separator 56 that collects produced fluids and separates the collected fluids into a gas phase, a liquid hydrocarbon phase, and an aqueous phase. The gas phase stream may then pass through a scrubber to remove entrained liquid before being compressed by a primary compressor 60. The system 10 may include startup recycle lines 64 (which are closed during normal operation) from the primary compressor 60 to each well 50 for initial startup of the system 10. During normal operation, the primary compressor 60 typically has a suction pressure of about 50 psig and compresses the gas stream up to about 1,200 psig. In conventional gas lift processes, the primary compressor 60 is used to inject lift gas directly from the primary compressor 60 to a well 50 typically in the range of 1,000 to 1,200 psig to provide artificial lift. The present compressor system 10 utilizes the compressor skid 20 described herein as a booster compressor 14 to further compress the gas for the HPGL process. Compressed gas exits the primary compressor 60 and flows to a booster compressor separator 62 that supplies gas to the compressor skid 20. Thus, the pressure in the gas inlet line 42 upstream of each control valve 40 may be up to about 1,200 psig, and the booster compressor 14 pressurizes the gas up to a maximum discharge pressure typically of about 4,000 psig. A common gas line from the booster compressor separator 62 splits into separate gas inlet lines 42 to supply gas to each of the compressor cylinders 16 on the compressor skid 20. An operator may input desired flow rate setpoints for the injection gas flow to each individual well 50 depending on the well conditions. For instance, if the gas flow rate setpoint for one well 50 requires gas at 4,000 psig to achieve the desired gas flow rate to the well 50, then the corresponding control valve 40 may remain fully open. However, if the gas flow rate setpoint for a second well 50 requires gas at 2,000 psig to achieve the desired gas flow rate to the second well 50, then the corresponding controller 48 will actuate the control valve 40 and adjust the valve position based on flow meter 46 readings measuring the flow rate in the gas inlet line 42. In this case, the valve 40 will partially close, thereby reducing the suction pressure to the compressor cylinder 16 to a pressure below 1,200 psig, which will in turn reduce the flow rate of compressed gas discharged from the cylinder 16 and injected into the tubing string 54 of the corresponding well 50. Thus, the injection gas flow rate to each individual well 50 may be independently controlled utilizing separate upstream control equipment on the suction lines 42 of each of the compressor cylinders 16, respectively.

The present HPGL booster compressor system 10 has a number of advantages over conventional gas lift systems and other HPGL systems. The present system 10 provides efficiency gains and cost reductions in several ways. First, because one compressor skid 20 can be used to service multiple wells 50, typically up to six wells, the number of compressors required to service numerous wells is greatly minimized. Because the gas flow rate of the discharge streams from a single compressor skid 20 can be controlled independently for each well, some of the discharge streams are not pressurized to the maximum discharge pressure and thus do not have to be pressured down to accommodate some of the individual wells 50 serviced by the skid 20 should those wells require a lower gas flow rate. Thus, hydrates formation is minimized or eliminated entirely, and the use of methanol to prevent hydrates formation is also eliminated. In addition, the physical size or "footprint" of the present HPGL booster compressor skid 20 is smaller than that of multiple compressor skids that would otherwise be required, which reduces both installation and operating costs. Reducing the number of compressor skids also minimizes the number of compressor engines 18, which minimizes engine exhaust emissions over that of multiple compressor skids. The present compressor system 10 provides these advantages while allowing operators of the system to independently optimize gas flow rates suitable for HPGL processes to multiple wells 50 simply by inputting a desired injection gas flow rate based on individual well conditions.

The present compressor system 10 is effective in providing compressed gas to multiple wells 50 for gas lift operations. Although the system 10 is most advantageous in HPGL operations, the system 10 may also be utilized for conventional gas lift to provide similar efficiency gains and cost reductions by eliminating the need to split gas flows to multiple wells and pressure down gas lines to some wells. In addition, the present compressor system 10 may also be utilized in other applications, including other artificial lift applications, such as with a gas-assisted plunger lift. A gas-assisted plunger lift typically requires discharge pressures of only up to about 400-500 psig. Thus, the present system may be utilized to provide conventional or high pressure gas lift in combination with a gas-assisted plunger lift by independently controlling the compressed gas discharge stream to each of multiple wellbores utilizing such artificial lift methods. Other application may include enhanced oil recovery (EOR), or tertiary recovery, and air drilling, in which high pressure air or nitrogen is injected downhole to cool a drill bit and lift cuttings of a wellbore when drilling. Accordingly, it should be understood by one of skill in the art that the present compressor system and method may be utilized whenever it is desirable to have multiple compressed gas streams from a single compressor unit that may be independently controlled without varying the speed of the compressor engine and without pressuring down individual gas streams.

It is understood that versions of the present disclosure may come in different forms and embodiments. Additionally, it is understood that one of skill in the art would appreciate these various forms and embodiments as falling within the scope of the invention as disclosed herein.

What is claimed is:

1. A gas compressor system for supplying compressed gas to a plurality of wellbores, said system comprising:

a compressor associated with a plurality of wellbores each having a tubing string positioned within the wellbore, wherein the compressor comprises a plurality of compressor cylinders and a compressor engine operably coupled to each of the compressor cylinders and configured to simultaneously drive all of the compressor cylinders in the plurality of compressor cylinders, wherein each compressor cylinder has a gas inlet line and a gas outlet line, wherein each gas outlet line is configured to inject compressed gas from one respective compressor cylinder into an interior of one respective tubing string at a subsurface location;

a plurality of control valves each corresponding to a respective compressor cylinder, wherein each respective control valve is positioned on one respective gas inlet line upstream of one respective compressor cylinder;

a plurality of flow meters each corresponding to a respective one of the plurality of control valves, wherein each flow meter is configured to measure a gas flow rate through one of the gas outlet lines; and a plurality of controllers each corresponding to a respective one of the plurality of control valves, wherein each controller is configured to receive gas flow rate signals from one respective flow meter and, in response, to send control signals that actuate the control valve corresponding to the respective flow meter to control suction pressure to the respective compressor cylinder that the control valve is positioned upstream of, wherein each control valve is configured to independently control suction pressure to each respective compressor cylinder and thereby to independently control a gas flow rate through each respective gas outlet line into each respective tubing string without varying the speed of the compressor engine.

2. The gas compressor system of claim 1, wherein the compressed gas is produced natural gas sourced from the plurality of wellbores.

3. The gas compressor system of claim 1, further comprising a plurality of coolers each corresponding to a respective compressor cylinder, wherein each respective cooler is configured to cool gas compressed by its respective compressor cylinder.

4. The gas compressor system of claim 1, further comprising a plurality of scrubbers each corresponding to a respective compressor cylinder, wherein each respective scrubber is configured to remove droplets from a gas stream upstream of its respective compressor cylinder.

5. The gas compressor system of claim 1, further comprising a three-phase separator configured to collect produced fluids and separate the collected fluids into a gas phase, a liquid hydrocarbon phase, and an aqueous phase.

6. The gas compressor system of claim 1, wherein the gas compressor is configured to inject a high pressure gas stream from a single source into different wellbores at different pressures without pressuring down the high pressure gas stream to a lower pressure.

7. The gas compressor system of claim 1, wherein the gas compressor system is configured to independently control a gas discharge flow rate from each of the compressor cylinders by independently controlling suction pressure to each of the cylinders.

8. The gas compressor system of claim 1, further comprising a common skid unit frame to which all system components are mounted.

9. A method for supplying compressed gas to a plurality of wellbores, said method comprising the steps of:

providing a plurality of wellbores each having a tubing string positioned within the wellbore;

providing a gas compressor system;

associating the gas compressor system with the plurality of wellbores, wherein the gas compressor system comprises:

a compressor comprising a plurality of compressor cylinders and a compressor engine operably coupled to each of the compressor cylinders and configured to simultaneously drive all of the compressor cylinders in the plurality of compressor cylinders, wherein each compressor cylinder has a gas inlet line and a gas outlet line, wherein each gas outlet line is configured to inject compressed gas from one respective compressor cylinder into an interior of one respective tubing string at a subsurface location;

a plurality of control valves each corresponding to a respective compressor cylinder, wherein each respective control valve is positioned on one respective gas inlet line upstream of one respective compressor cylinder;

a plurality of flow meters each corresponding to a respective one of the plurality of control valves, wherein each flow meter is configured to measure a gas flow rate through one of the gas outlet lines; and a plurality of controllers each corresponding to a respective one of the plurality of control valves, wherein each controller is configured to receive gas flow rate signals from one respective flow meter and, in response, to send control signals that actuate the control valve corresponding to the respective flow meter to control suction pressure to the respective compressor cylinder that the control valve is positioned upstream of, wherein each control valve is configured to independently control suction pressure to each respective compressor cylinder and thereby to independently control a gas flow rate through each respective gas outlet line into each respective tubing string without varying the speed of the compressor engine;

using the compressor to inject compressed gas into the tubing string of each of the plurality of wellbores; and independently controlling the gas flow rate into each respective tubing string by independently controlling each of the control valves upstream of each respective compressor cylinder.

10. The method of claim 9, wherein the step of injecting compressed gas into each tubing string comprises injecting produced natural gas sourced from the plurality of wellbores.

11. The method of claim 9, wherein the compressor further comprises a plurality of coolers each corresponding to a respective compressor cylinder, wherein each respective cooler is configured to cool gas compressed by its respective compressor cylinder, the method further comprising using the coolers to cool the compressed gas flowing through each of the outlet lines.

12. The method of claim 9, wherein the compressor further comprises a plurality of scrubbers each corresponding to a respective compressor cylinder, wherein each respective scrubber is configured to remove droplets from a gas stream upstream of its respective compressor cylinder, the method further comprising using the scrubbers to remove liquid from each of the gas inlet lines upstream of each compressor cylinder.

13. The method of claim 9, wherein the compressor further comprises a three-phase separator configured to collect produced fluids and separate the collected fluids into a gas phase, a liquid hydrocarbon phase, and an aqueous phase.

14. The method of claim 9, wherein the compressor injects a high pressure gas stream from a single source into different wellbores at different pressures without pressuring down the high pressure gas stream to a lower pressure.

15. The method of claim 9, wherein the gas compressor is configured to independently control a gas discharge flow rate from each of the compressor cylinders by independently controlling a suction pressure to each of the cylinders.

16. The method of claim 9, wherein the compressor further comprises a common skid unit frame to which all the compressor components are mounted.

17. The method of claim 9, further comprising the step of supplying gas from the compressor at a first pressure to a booster compressor, wherein the booster compressor increases the gas pressure to a second, higher pressure.

18. The method of claim 17, wherein the first pressure is up to about 1200 psig and the second pressure is up to about 4000 psig.

* * * * *